US006088551A

United States Patent [19]

Satoh et al.

[11] Patent Number: 6,088,551

[45] Date of Patent: Jul. 11, 2000

[54] CHARGING DEVICE FOR IMAGE FORMING APPARATUS

[75] Inventors: Masumi Satoh; Takaya Muraishi, both of Yokohama, Japan

[73] Assignee: Ricoh Company, Ltd., Tokyo, Japan

[21] Appl. No.: 09/198,614

[22] Filed: Nov. 24, 1998

[30] Foreign Application Priority Data

Nov. 26, 1997 [JP] Japan ..... 9-324839

[51] Int. Cl.[7] ..... G03G 15/02

[52] U.S. Cl. ..... 399/100; 399/176

[58] Field of Search ..... 399/98, 99, 100, 399/168, 174, 175, 176

[56] References Cited

U.S. PATENT DOCUMENTS

| | | | |
|---|---|---|---|
| 4,339,195 | 7/1982 | Gabelman | 399/100 |
| 5,557,373 | 9/1996 | Miyashita et al. | 399/176 X |
| 5,610,691 | 3/1997 | Takahashi et al. | 399/176 |
| 5,619,311 | 4/1997 | Kurokawa et al. | 399/176 |
| 5,659,853 | 8/1997 | Matsuda et al. | 399/176 |
| 5,678,136 | 10/1997 | Watanabe et al. | 399/100 |
| 5,799,229 | 8/1998 | Yokoyama et al. | 399/100 |
| 5,822,658 | 10/1998 | Tanaka et al. | 399/174 |

FOREIGN PATENT DOCUMENTS

| | | |
|---|---|---|
| 2-272594 | 11/1990 | Japan . |
| 5-297690 | 11/1993 | Japan . |
| 7-199604 | 8/1995 | Japan . |

*Primary Examiner*—Sandra Brase

*Attorney, Agent, or Firm*—Oblon, Spivak, McClelland, Maier & Neustadt, P.C.

[57] ABSTRACT

A charging device for an image forming apparatus includes a charging roller which contacts a surface of a photoconductive element under pressure and is caused to rotate by a rotation of the photoconductive element in which the charging roller charges the surface of the photoconductive element while rotating, and a cleaning member which contacts a surface of the charging roller, even when an image forming operation is performed, and cleans the surface of the charging roller. The cleaning member is made of an elastic material and is supported by a supporting member. The supporting member includes an elastic distortion suppressing member which suppresses a distortion of the cleaning member caused by the rotation of and made in a rotating direction of the charging roller.

3 Claims, 3 Drawing Sheets

CHARGING DEVICE FOR IMAGE FORMING APPARATUS

BACKGROUND OF THE INVENTION

1. Field of the Invention

The present invention relates to a charging device for an image forming apparatus, and more particularly, to a charging device for an image forming apparatus which has a charging roller that charges a photoconductive element while being driven by a rotation of the photoconductive element, and a cleaning member made of an elastic member, which cleans a surface of the charging roller contacting thereto during the image forming process.

2. Discussion of the Background

An electrophotographic image forming apparatus is generally provided with a charging device that charges a surface of the photoconductive element. Recently, a charging device that has a charging roller for charging the surface of the photoconductive element by contacting the charging roller thereto has been widely used in place of the older corona discharging-type charging device. This is because the charging roller produces less ozone than the corona discharging-type device.

Such a contact-charging type charging device which performs a charging operation with the charging roller contacting the photoconductive element may cause an insufficient charge due to the adhesion of residual toner remaining on the photoconductive element, after the image on the photoconductive element is transferred to a transfer sheet to the photoconductive element.

In order to avoid an occurrence of insufficient charge due to the adhesion of residual toner in the charging device, a cleaning member made of, for example, a sponge or the like is configured to contact a surface of the charging roller with such an appropriate pressure that the contacting portion of the cleaning member is deformed. Thereby, the charging roller is rubbed at the surface thereof with the cleaning member when rotating. As a result, toner, paper powder and the like which adhere on the surface of the cleaning roller are removed (as described in, for example, Japanese Laid-Open Patent Publication No. 272594/1990).

However, when the charging roller is cleaned at its surface with such an elastic cleaning member, the cleaning member is deformed toward the rotating direction of the charging member due to a friction force caused by the contact of the cleaning member with the rotating photoconductive element. If the friction force is excessively large, a further problem may be caused in which the cleaning member may be peeled off or may fall off a supporting member that supports the cleaning member with an adhesive.

In addition, a contact area between the cleaning member and the charging roller may vary due to the distortion of the cleaning member toward the rotating direction of the charging roller. This variation of the contact area of the cleaning member with the charging roller may thereby vary a friction load which is added to the charging roller from the cleaning member. Consequently, the rotational speed of the charging roller may become erratic. Furthermore, when the charging roller is rubbed at the surface thereof with the cleaning member to an excessive extent, the charging roller may cause a so-called "filming phenomenon" in which the toner accretes to the surface of the charging roller by heat.

SUMMARY OF THE INVENTION

The present invention has been made in view of the above-discussed problems and an object of the invention is to address and resolve these and other problems.

Accordingly, a novel charging device for an image forming apparatus includes a charging roller which contacts a surface of a photoconductive element under pressure and is caused to rotate by a rotation of the photoconductive element, in which the charging roller charges the surface of the photoconductive element while rotating. The apparatus also includes a cleaning member which contacts a surface of the charging roller, even when an image forming operation is performed, and thereby cleans the surface of the charging roller. The cleaning member is made of an elastic material and is supported by a supporting member. The supporting member includes an elastic distortion suppressing member which suppresses a distortion of the cleaning member caused by the rotation of the charging roller.

According to one embodiment of the present invention, an area of an end surface of the cleaning member in contact with the charging roller is smaller than an area of an opposite end surface of the cleaning member at which the cleaning member is fixed to the supporting member.

According to a further embodiment, an end surface of the cleaning member in contact with the charging roller contacts at an entire area thereof with the surface of the charging roller.

According to yet another embodiment, the cleaning member is be disposed so that one of the edges of an end surface of the cleaning member contacts a circumferential surface of the cleaning roller at a point within an area which is defined by an angle of 22.5° on each side of the point. A first line passing through the point and perpendicular to a supporting surface of the supporting member is located a distance $r/\sqrt{2}$ from a second line which is parallel to the first line, is perpendicular to the supporting surface of the supporting member or an extension line thereof and passes through a rotation center of the charging roller, in which r represents a radius of the charging roller.

Other objects, features and advantages of the present invention will become apparent from the following detailed description when read in conjunction with the accompanying drawings. Furthermore, while the drawings and descriptions illustrate specific structures, the present specification clearly explains the functions, concepts and attributes of the present invention in sufficient detail so as to make clear all equivalent structures and techniques for obtaining the desired result.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
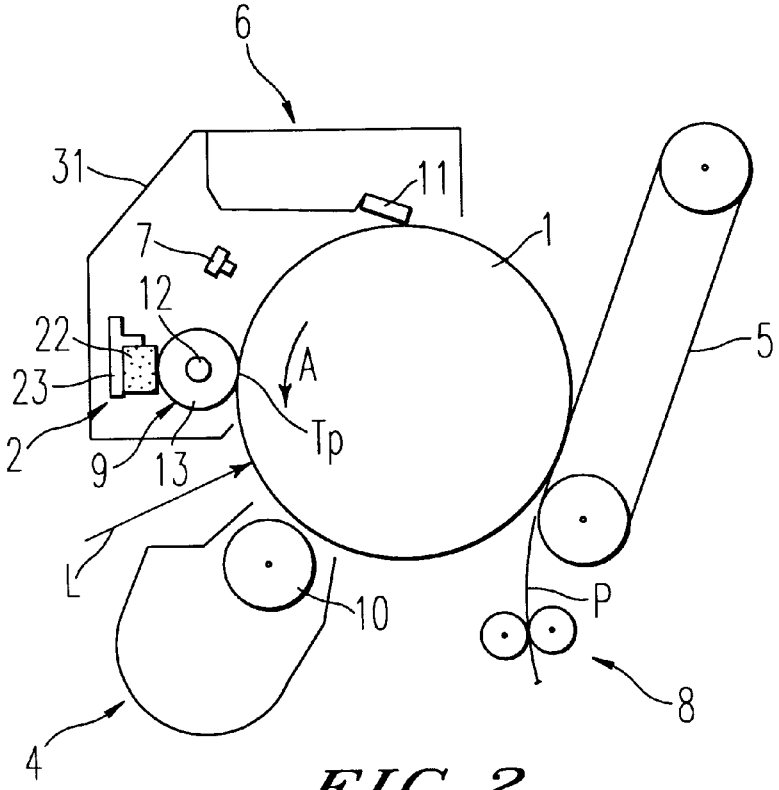
FIG. 2 is a schematic drawing illustrating an image forming section of the image forming apparatus provided with the charging device illustrated in FIG. 1.

Hereinbelow, an embodiment of the present invention is described referring to the figures. An image forming section of an image forming apparatus of FIG. 2 is provided with a charging device 2 having a charging roller 9 that uniformly charges a surface of a photoconductive element 1 with a voltage applied from a power source (not shown), wherein the charging roller 9 is driven by a rotation of the photoconductive element 1 being pressed thereon. The charging device 2 is located adjacent the drum shaped photoconductive element 1 which rotates in a direction indicated by an arrow A. The image forming apparatus is further provided with an exposing device (not shown) that forms an electrostatic latent image by irradiating laser light L onto the photoconductive element 1 and a developing device 4 that develops the electrostatic latent image into a visible image.

In addition, a transfer belt 5 that transfers a toner image formed with the developing device onto a transfer sheet P, a cleaning device 6 that removes residual toner remaining on the photoconductive element 1 after the toner is transferred onto the transfer sheet P, and a discharging lamp 7 that discharges remaining charge are disposed around the photoconductive element 1.

The charging roller 9 of the charging device 2 is made of a conductive rubber 13 having a stable electric resistance and a low hygroscopicity, mounted around a circumference of a metal shaft 12 except at both side ends thereof. The charging roller 9 uniformly charges the surface of the photoconductive element 1 by a high voltage applied to the shaft 12 with the conductive rubber 13 which is rotatably driven by being continuously pressed against the surface of the photoconductive element 1.

Figure 1:
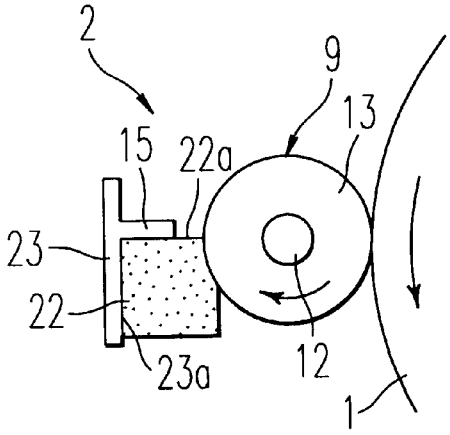
FIG. 1 is a schematic drawing illustrating an exemplary embodiment of a charging device for the image forming apparatus according to the present invention.

As shown in FIG. 1, a cleaning member 22 continuously contacts the surface of the charging roller 9 with positive pressure, even when performing image forming operation. The cleaning member 22 is made of an elastic material composed of foam such as, for example, a sponge or the like and is adhered to a cleaning member supporting member 23 with an adhesive agent, for example, a double coated adhesive tape or the like. Accordingly, the cleaning member 22 contacts the surface of the charging roller 9 to clean the surface thereof.

In addition, an elastic distortion suppressing member 15 for suppressing the distortion of cleaning member 22 along a rotating direction (a direction of an arrow B) of the charging roller 9 when the charging roller 9 rotates is formed on the cleaning member supporting member 23. The elastic distortion suppressing member 15 projects at approximately a right angle to a cleaning member supporting face 23*a*. The elastic distortion suppressing member 15 is provided with a width sufficient for contacting the entire length of end face 22*a* of the cleaning member 22 along a longitudinal direction of, for example, the cleaning member supporting member 23, i.e., a direction parallel to the axis of rotation of charging roller 9.

Further, the elastic distortion suppressing member 15 is preferably provided with a height, as measured from the surface 23*a* of cleaning member supporting member 23, such that a tip 15*a* approaches, but does not touch, the surface of the photoconductive element 1. The gap between tip 15*a* and the surface of photoconductive element 1 must be sized in consideration of the inherent inaccuracies of manufacturing and fabrication.

When the image forming operation starts, the image forming apparatus starts rotation of the photoconductive element 1 in a direction indicated by an arrow A as shown in FIG. 2. In addition, the surface of the photoconductive element 1 is discharged by discharging light irradiated from the discharging lamp 7 and a surface voltage of the discharged part is evened off at a basement potential level of 0 V to −150 V. The surface of photoconductive element 1 is then charged by the charging roller 9 to a voltage of about −1000 V.

To the charged surface of the photoconductive element 1, laser light L is irradiated from an exposing device (not shown), and thereby, a surface voltage of the part on the photoconductive element 1 where an image is formed becomes 0 V to −200 V by irradiating the laser light L. Therefore, toner on a developing sleeve 10 of the developing device 4 is electrostatically adhered to the part of the photoconductive element 1 where the image is formed. The toner image formed on the photoconductive element 1 is then moved to a transfer position, where the photoconductive element 1 and the transfer belt 5 contact, by the rotation of the photoconductive element 1 in a direction indicated by the arrow A.

A transfer sheet P is fed from a sheet feeding device (not shown), and is conveyed by a registration rollers pair 8 at a timing of which the tip end portion of the transfer sheet P is adjusted to a tip portion of the toner image formed on the photoconductive element 1. The toner image on the photoconductive element 1 is then transferred onto the surface of the transfer sheet P.

The transfer sheet P is then conveyed to a fixing section, and the toner image is melted and fixed to the transfer sheet P by heat and pressure provided thereto. The transfer sheet P is thereafter discharged to a sheet discharging tray or the like. The toner remaining on the photoconductive element 1 is scraped off by the cleaning blade 11 of the cleaning device 6 and the surface of the photoconductive element 1 is thereafter discharged by the discharging lamp 7. Hereinafter, this image forming process is repeated.

Figure 3:
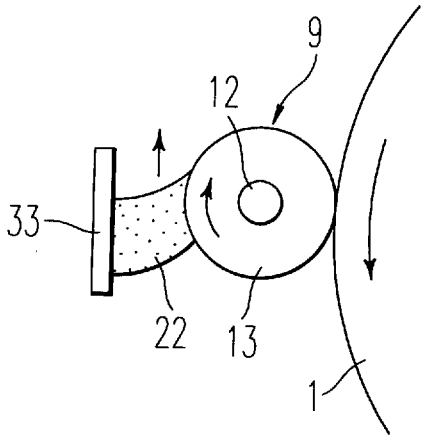
FIG. 3 is a schematic drawing illustrating a state of elastic distortion of the cleaning member caused by being moved to a rotating direction of the charging roller by friction force.

However, when the surface of the charging roller 9 is cleaned by contact with cleaning member 22 composed of the elastic material, the cleaning member 22 is elastically distorted in the rotational direction of the charging roller 9, by a frictional force as shown in FIG. 3. When the frictional force is excessively strong, the cleaning member 22 may be peeled off from supporting member 33.

Further, when a contact area between cleaning member 22 to the charging roller 9 is increased by the distortion of the cleaning member 22 toward the rotating direction of the charging roller 9, for example, the frictional load imparted to the charging roller 9 by the cleaning member 22 is also increased. This varying frictional load causes the rotational speed of the charging roller 9 to become erratic. Such erratic speed charges prevent a smooth rotation of the charging roller 9, thereby causing slippage between the charging roller 9 and the surface of the photoconductive element 1.

Furthermore, when heat is generated by excessive rubbing of the cleaning member 22 to a surface of the charging roller 9, a filming phenomenon may be caused. However, as illustrated in FIG. 1, since the elastic distortion suppressing member 15 suppresses the elastic distortion of cleaning member 22 the above described various problems can be prevented.

In other words, the elastic distortion suppressing member 15 suppresses a distortion even when the cleaning member 22, which contacts the surface of the charging roller 9, is moved, and tends to be elastically distorted to the rotating direction of the charging roller 9 by the rotation thereof as indicated by the arrow B. Therefore, since the cleaning member 22 is prevented from being peeled off from the cleaning member supporting member 23, and is capable of suppressing a substantial increase of the contact area to the cleaning member 22 with the charging roller, the charging roller 9 can smoothly be rotated while a variation in of frictional force is suppressed. Accordingly, stable charging can be achieved and the occurrence of the filming phenomenon can be prevented.

Figure 4:
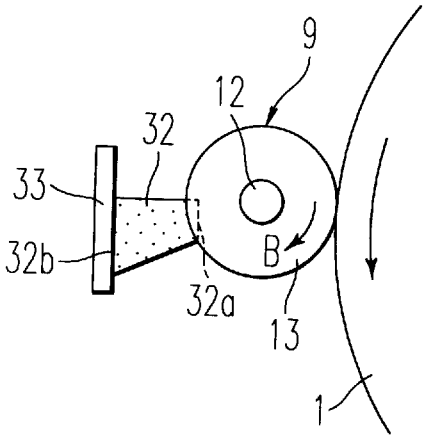
FIG. 4 is a schematic drawing illustrating another exemplary embodiment of the charging device at which variation of the cleaning member is used.

FIG. 4 is a schematic drawing illustrating another exemplary embodiment of the charging device using a cleaning member formed of a shape different from the aforementioned cleaning member 22. The same numerals represent the same elements of FIG. 1. In this charging device, an area of an end face 32*a* of cleaning member 32 which contacts the surface of the charging roller 9 is smaller than that of end face 32*b* which is fixed to supporting member 33 opposite end face 32*a*.

By constructing end face 32*b* with a surface area larger than that of the end face 32*a*, the cleaning member 32 is not peeled off. This is because the cleaning member 32 is securely supported on the cleaning member supporting member 33 by a supporting force corresponding to a size of the contact area between the cleaning member 32 and the supporting member 33, even when a force which would tend to peel off the cleaning member 32 from the cleaning member supporting member 33 is applied by the rotation of charging roller 9.

Preferably, cleaning member 32 may is positioned so that end surface 32*a* contacts the surface of the charging roller 9. Thereby, even though the cleaning member 32 elastically distorts toward a rotating direction (indicated by the arrow B) of the charging roller 9 when the charging roller 9 rotates, a contact area between end face 32*a* and charging roller 9 scarcely varies, and therefore, a frictional load applied to the charging roller 9 from the cleaning member 32 does not vary. Thereby, an erratic or uneven rotational speed of the charging roller 9 does not occur. Accordingly, a stable charging operation can be performed.

Figure 5:
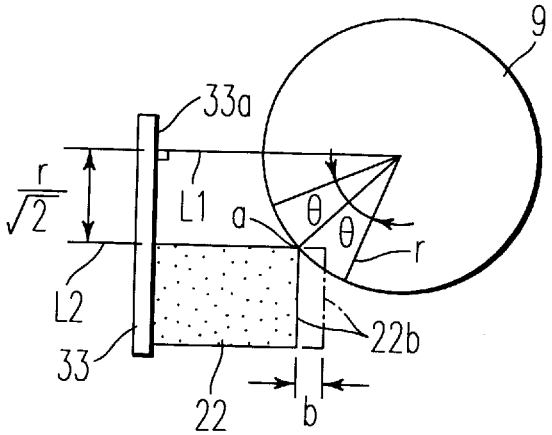
FIG. 5 is a schematic drawing illustrating still another exemplary embodiment of the charging device at which a positional relationship of the cleaning member to the charging roller is specified.

FIG. 5 is a schematic drawing illustrating still another exemplary embodiment of the present invention relevant to the charging device which incorporates a specific positional relationship between a cleaning member and a charging roller. The same numerals represent the same elements corresponding to those in FIG. 1.

Cleaning member 22 is disposed so that an edge of end surface 22*b* of the cleaning member 22, at a contact side of the cleaning member 22, contacts a circumferential surface of the charging roller 9 at a point within an area which is defined by an angle θ, in which θ=22.5°. As shown in FIG. 5, the preferred contact area extends downstream (along the direction of rotation) by angle θ, and upstream (opposite to the direction of rotation) also by angle θ, from a center point a. A first line L2 passing through the point a and perpendicular to a supporting surface 33*a* of the supporting member 33 has a distance $r/\sqrt{2}$ from a second line L1 which is parallel to first line L2, which is also perpendicular to the supporting surface 33*a* of the supporting member 33 and which passes through a rotation center of the charging roller 9. Here, r represents a radius of the charging roller 9. Furthermore, after the cleaning member 22 is installed, end surface 22*b* of the cleaning member 22 is compressed by an appropriate amount "b" away from the surface of the charging roller 9.

Figure 6:
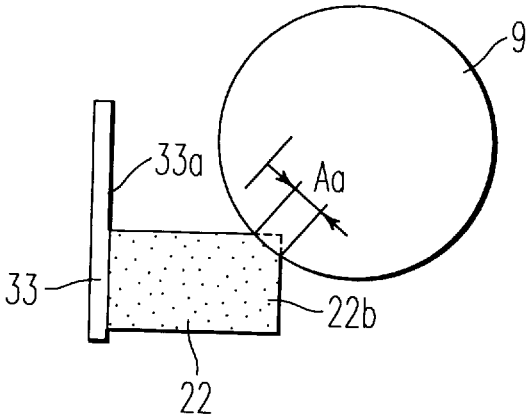
FIG. 6 is a schematic drawing illustrating that when a cleaning member is disposed at a position specified in FIG. 5, fluctuation of the contact area with the charging roller is minimized even when the cleaning member wears by elapse of time.

As described above, since the fluctuation of the contact area Aa of the cleaning member 22 to the charging roller 9 can be minimized, even though the cleaning member 22 is worn over time, as shown in FIG. 6, the charging roller 9 can be stably rotated at constant speed by suppressing the variation of the frictional load applied by the cleaning member 22 to the charging roller 9.

Figure 7:
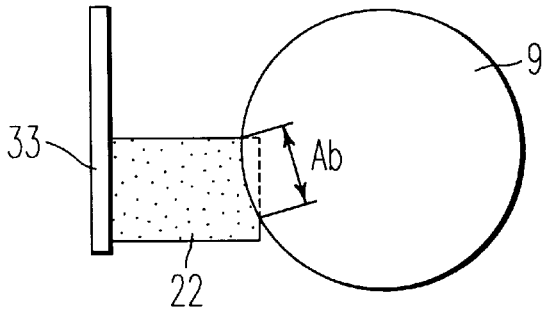
FIG. 7 is a schematic drawing illustrating that depending on a position of the cleaning member disposed around the charging roller, the fluctuation of the contact area of the cleaning member with the charging roller becomes exceedingly large when the cleaning member wears by elapse of time.
Figure 8:
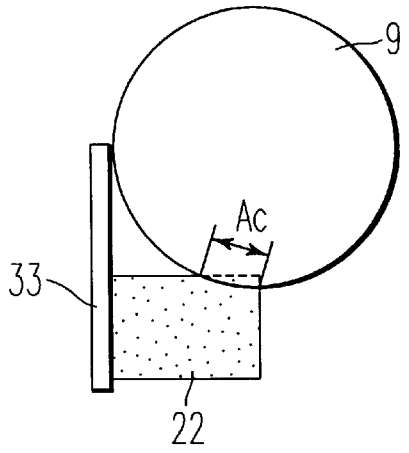
FIG. 8 is a schematic drawing illustrating that the fluctuation of contact area of the cleaning member with the charging roller becomes exceedingly large by elapse of time at a position different from that in FIG. 7.

When the cleaning member 22 is disposed at a position shown in FIGS. 7 and 8, in contact with the charging roller 9, the variation of the contact area of the cleaning member 22 to the charging roller 9 (Ab in FIG. 7 and Ac in FIG. 8) becomes extremely large as cleaning member 22 is worn down. Thereby, the frictional load applied by the cleaning member 22 to the charging roller 9 excessively increases resulting in an erratic or varying rotational speed of the charging roller 9. However, when L1 is spaced from L2 at approximately $r/\sqrt{2}$, in accordance with the charging device shown in FIG. 5, such a problem does not occur.

Figure 9:
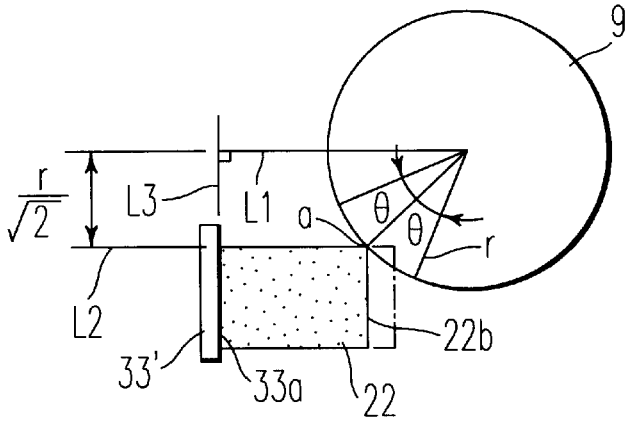
FIG. 9 is a schematic drawing similar to FIG. 5, illustrating still another exemplary embodiment in which the cleaning member is disposed at a position where the fluctuation of contact area of the cleaning member with the charging roller is made minimum even when the cleaning member wears by elapse of time.

Furthermore, when a cleaning member supporting member 33' shown in FIG. 9 has a small configuration such that the supporting member 33' does not meet with the perpendicular line L1, the cleaning member 22 is disposed so that one of the edges (upper edge in FIG. 9) of the end surface 22*b* of the cleaning member 22 contacts the surface of the charging roller 9 within the area which is defined by the angle θ, in which θ=22.5° as shown in FIG. 9. The preferred contact area extends downstream (along the direction of rotation) by angle θ, and extends upstream (opposite to the direction of rotation) also by angle θ, from a center point a. First line L2 passing through the point a and perpendicular to an extension line of the supporting surface of the supporting member 33' has a distance $r/\sqrt{2}$ from the second line L1 which is parallel to the first line L2, perpendicular to the extension line L3 of the supporting surface 33*a* and passes through a rotation center of the charging roller 9. Here, r represents a radius of the charging roller 9.

Obviously, numerous modifications and variations of the present invention are possible in light of the above teachings. It is therefore to be understood that within the scope of the appended claims, the invention may be practiced otherwise than as specifically described herein.

Having now fully described the present invention, it will be apparent to one of ordinary skill in the art that many changes and modifications can be made thereto without departing from the spirit and scope of the invention as set forth herein. This application is based on Japanese Patent Application No. 09-324839 filed on Nov. 26, 1997, the entire contents of which are hereby incorporated by reference.

What is claimed is:

1. A charging device for an image forming apparatus, comprising:

a charging roller configured to contact a surface of a photoconductive element under pressure, configured to be rotated by rotation of said photoconductive element, and configured to charge a surface of said photoconductive element while rotating;

a supporting member;

a cleaning member supported by said supporting member and arranged to contact a surface of said charging roller, at least during an image forming operation, and configured to clean said surface of said charging roller, wherein said cleaning member is formed of an elastic material and is supported by said supporting member, said cleaning member having a first end surface in contact with said charging roller and a second end surface fixed to said supporting member, wherein said first end surface is smaller than said second end surface.

2. A charging device for an image forming apparatus, comprising:

a charging roller configured to contact a surface of a photoconductive element under pressure, configured to be rotated by a rotation of said photoconductive element, and configured to charge a surface of said photoconductive element while rotating;

a supporting member;

a cleaning member supported by said supporting member and arranged to contact a surface of said charging roller, at least during an image forming operation, and configured to clean said surface of said charging roller, wherein said cleaning member is formed of an elastic material and is supported by said supporting member, said cleaning member having an first end surface in contact with said charging roller and a second end surface fixed to said supporting member, wherein said first end surface is smaller than said second end surface.

3. The charging device for an image forming apparatus according to claim 1, wherein said cleaning member is disposed so that an edge of said cleaning member contacts a circumferential surface of said charging roller within an area which is defined by angle of 22.5° from a point, along a rotating direction of said charging roller and an angle of 22.5° from said point, along a direction opposite to said rotating direction, wherein a first line passing through said point and perpendicular to a supporting surface of said supporting member has a distance $r/\sqrt{2}$ from a second line which is parallel to said first line, perpendicular to said supporting surface of said supporting member or an extension line thereof, and passes through a rotation center of said charging roller, wherein r is a radius of said charging roller.

* * * * *

UNITED STATES PATENT AND TRADEMARK OFFICE

CERTIFICATE OF CORRECTION

PATENT NO. : 6,088,551

DATED : July 11, 2000

INVENTOR(S): Masumi SATO, et al.

It is certified that an error appears in the above-identified patent and that said Letters Patent is hereby corrected as shown below:

On the title page, item [75], the first applicant's named is misspelled. It should read as follows:

--[75] Inventors: Masumi Sato; Takaya Muraishi, both of Yokohama, Japan--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*